United States Patent [19]

Marcyniuk

[11] 4,248,585

[45] Feb. 3, 1981

[54] FLARE IGNITION APPARATUS

[75] Inventor: Orest P. Marcyniuk, Hamshire, Tex.

[73] Assignee: Gulf Oil Corporation, Pittsburgh, Pa.

[21] Appl. No.: 966,251

[22] Filed: Dec. 4, 1978

[51] Int. Cl.[3] ..... F23D 13/20

[52] U.S. Cl. ..... 431/202; 431/5

[58] Field of Search ..... 431/1, 5, 67, 86, 202

[56] References Cited

U.S. PATENT DOCUMENTS

| | | | |
|---|---|---|---|
| 2,460,016 | 1/1949 | Kuhn | 431/202 X |
| 2,537,091 | 1/1951 | Rodman et al. | 431/202 X |
| 3,729,287 | 4/1973 | Strashok | 431/202 |
| 3,756,765 | 9/1973 | Sparrow et al. | 431/202 |
| 3,833,336 | 9/1974 | Ray | 431/202 |
| 3,837,785 | 9/1974 | Evans et al. | 431/202 X |
| 3,994,671 | 11/1976 | Straitz | 431/202 |

*Primary Examiner*—Robert S. Ward, Jr.

[57] ABSTRACT

An igniter for a flare stack for waste gases is actuated periodically by an intermittently firing spark plug. A fuel gas for ignition aspirates combustion air through openings in a housing enclosing a supply line for the fuel gas. Flashback from the intermittent ignition of the fuel gas is prevented and noise is reduced by closure means responsive to the pressure differential between the interior of the housing and the ambient air. The closure means close the openings when the pressure within the housing is higher than the pressure of the ambient air.

15 Claims, 2 Drawing Figures

FLARE IGNITION APPARATUS

BACKGROUND OF THE INVENTION

1. Field of the Invention

This invention relates to a flare stack for burning waste gas and more particularly to an igniter for maintaining combustion at the discharge end of the flare stack.

2. Description of the Prior Art

In many petroleum and chemical operations, combustible vapors are discharged from processing vessels or displaced from tanks as they are being filled. The vapors may be diluted with air or vary so widely in composition and rate of flow that they cannot effectively be processed. It is a conventional process to deliver such vapors into a flare stack and burn the vapors as they are discharged from the end of the flare stack. The flame at the discharge end of the stack may be extinguished by wind or rain or by a reduction in the flow rate or combustibles content of the gas below the level required to maintain combustion. It is desirable to provide means for igniting the flare. Because flares are frequently 60 or more feet high and because a large flame may be developed as the flares are ignited, it is desirable to provide automatic ignition means that are operated at a substantial distance from the discharge end of the flare stack.

U.S. Pat. No. 2,460,016 of Kuhn describes apparatus which includes a pilot flare that burns continuously near the discharge end of the stack. In the apparatus described, the pilot flare utilizes the same gas that is burned at the outlet of the flare stack to ignite the gases discharged from the stack. The pilot flare is exposed to substantially the same conditions which make maintenance of combustion at the discharge end of the stack difficult. U.S. Pat. No. 2,460,016 describes means for igniting the pilot flare by initiating combustion near the bottom of an ignition tube. A flame travels upwardly through the ignition tube to ignite combustible gas delivered to the pilot flare.

U.S. Pat. No. 2,537,091 of Rodman et al describes apparatus generally similar to the apparatus described in U.S. Pat. No. 2,460,016, with the exception that a separate supply of fuel gas, rather than the waste gas, is used for the pilot flare. A manually operated spark plug initiates a flame which travels to the top of the stack through a riser. A stream of the fuel gas is discharged directly into the stack and is ignited at the discharge end thereof by the flame from the riser to provide the pilot flare.

U.S. Pat. No. 3,833,336 of Ray describes apparatus in which a fuel such as LPG is utilized to maintain a pilot flare near the top of the flare stack. The fuel is also discharged, in response to a signal indicating the pilot flare is out, into the lower portion of an open bottomed igniter pipe. The fuel discharged into the lower end of the pipe aspirates air into the pipe and the resultant mixture is ignited by a spark plug adjacent the outlet of the fuel supply line. If the pilot flare should go out, a signal actuated manually or by a circuit in response to a flame detector opens a valve in the fuel gas line to the igniter pipe and activates the spark plug.

To avoid the necessity of the continued observance of the upper end of the stack or a flame detector, an ignition system has been developed in which a fuel gas supplied to an igniter aspirates combustion air into the fuel gas stream and is ignited intermittently, for example, every 5 seconds by a spark plug. The resulting flame travels to the discharge end of the flare stack through a conduit in which there is a combustible mixture of a fuel gas and air and ignites waste gas at the discharge end of the flare stack. The repeated ignition avoids the possibility of the flare being extinguished for a period adequate to allow any substantial discharge of unburned waste gases from the top of the stack. The intermittent operation resulting from the periodic spark causes surges in pressure with resultant flashback and noise.

SUMMARY OF THE INVENTION

This invention resides in apparatus for maintaining combustion at the discharge end of a flare stack in which a small continuous stream of fuel gas is intermittently ignited at the lower end of a conduit that extends to the discharge end of the flare stack. The flame generated travels upwardly through a combustible mixture in the conduit to ignite waste gases at the outlet of the flare stack. Aspiration of combustion air into the gas stream is through ports in a housing enclosing the outlet of the fuel gas supply line. Flashback is prevented and noise is reduced by closure means operable in response to pressure differential to close the openings when pressure in the housing is higher than the ambient pressure.

DESCRIPTION OF PREFERRED EMBODIMENT

Figure 1:
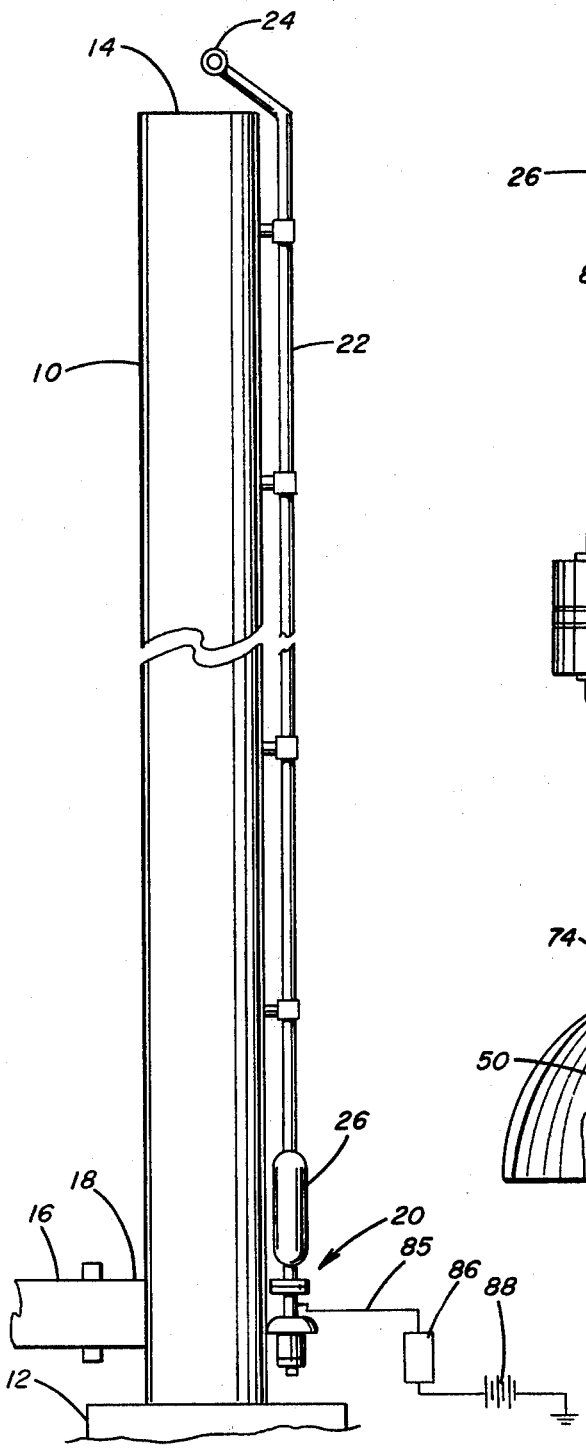
FIG. 1 is a diagrammatic view in elevation of the apparatus of this invention mounted on a flare stack.

Referring to FIG. 1 of the drawings, a flare stack 10 is shown extending upwardly from a base 12 to its discharge end 14. While a vertical flare stack is shown in the drawings and will be described, the flare stack may be, and in some instances is, horizontal to burn the combustible gases at a remote location where the flame causes no problem. A waste gas delivery line 16 is connected to an inlet nozzle 18 at the lower end of the flare stack 10 for delivery of waste gases from processing units or storage into the flare stack.

Supported by brackets from the outer surface of the flare stack 10 is an igniter indicated generally by reference numeral 20. The igniter 20 includes a conduit 22 that extends upwardly to the discharge end 14 of the flare stack 10. Preferably, conduit 22 is angled over the discharge end of the flare stack to terminate in the effluent stream flowing from the flare stack. In the preferred embodiment shown, a tee 24 is connected to the upper outlet end of the conduit 22 with the run of the tee horizontal to distribute the igniter flame over the discharge end 14 of the flare stack. The uppermost eight feet to ten feet of conduit 22 is of stainless steel pipe and the tee is fashioned from stainless steel pipe to withstand the high temperatures to which they are subjected. Conduit 22 includes near its lower end a separation chamber 26 for the separation of condensate, as hereinafter described. In a typical installation, conduit 22 is constructed of $1\frac{1}{2}$ inch pipe with the tee 24 being an ordinary pipe tee and the expansion chamber 26 comprising a section of 2 inch pipe 28 four feet long connected to the $1\frac{1}{2}$ inch pipe of the conduit by an upper and a lower bell reducer 30 and 32 best illustrated in FIG. 2. An insulating flange connection 34 which includes an insulating gasket is provided in the lower part of the conduit 22.

Figure 2:
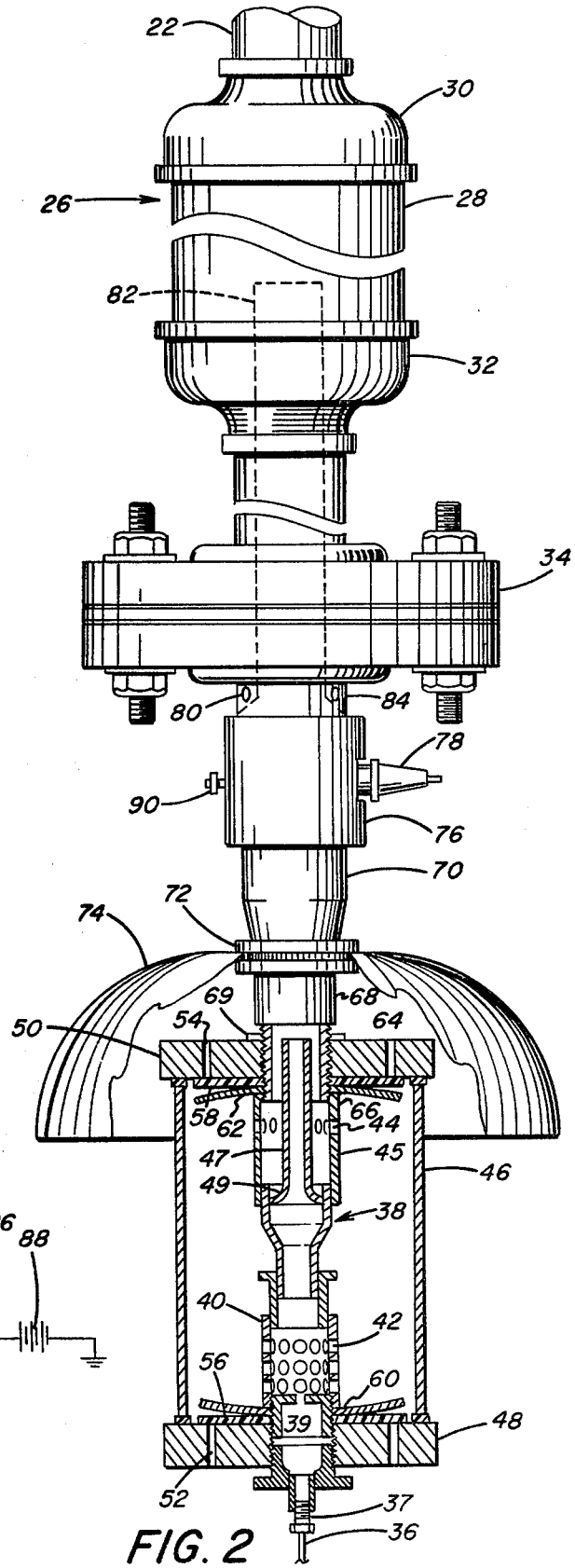
FIG. 2 is an elevational view partially broken away and partially in vertical section of the lower end of the flare stack igniter of this invention.

Referring to FIG. 2, a plastic fuel supply tubing 36 from a fuel supply (not shown) such as a natural gas line or an LPG tank is connected by a tubing connector 37 into a pipe indicated generally by reference numeral 38. Pipe 38 is shown comprising a plurality of fittings that provide a tubular member connected to deliver a mixture of fuel gas and air into the lower end of conduit 22. Within pipe 38 is an orifice 39 adapted to discharge a stream of fuel gas into a coupling 40 forming a part of the pipe 38. Orifice 39 is typically 1/64 inch in diameter. A plurality of air supply ports 42 in coupling 40 permit flow into the pipe. The arrangement of the orifice 39 within pipe 38 creates an aspirator which draws air through the ports 42 when fuel gas is discharged from the aspirator. Additional ports 44 are provided in a nipple 45 further downstream in pipe 38 for induction of additional air for combustion of fuel discharged from tubing 36.

Within the nipple 45 is a nozzle 47 that further increases the aspiration of air. The lower end of the nozzle 47 is expanded to bear against the inner wall of pipe 38. Nozzle 47 has an outer diameter less than the inner diameter of pipe 38. The nozzle, which preferably is a short section of copper tubing, is held in place by solder or other suitable material 49. Nozzle 47 extends vertically upward within pipe 38 to discharge gases flowing through it at a location downstream of ports 44.

The pipe 38 is enclosed within a housing comprising a sleeve 46, preferably of a transparent acrylic plastic, to allow observation of conditions within the housing. Sleeve 46 is closed at its lower end by a lower flange 48. Sleeve 46 is closed at its lower end by a lower flange 48 and at its upper end by an upper flange 50. Air supply openings 52 and 54 extend through flanges 48 and 50, respectively. In the vertical sectional view of FIG. 2, only two openings in each flange show. In a typical installation, each flange will have sixteen openings equally spaced around the pipe 38. Flexible gaskets 56 and 58 secured against the inner faces of the flanges by dish-shaped washers 60 and 62 extend radially beyond the openings to overlie the downstream end, i.e., the end within the housing, of openings 52 and 54. Washers 60 and 62 limit travel of the gaskets 56 and 58 and thereby cause quicker response to pressure changes. A nipple 64 connected at the downstream end of pipe 38 by a coupling 66 extends through the upper flange 50 and is connected at its upper end into a coupling 68. A locknut 69 is provided to prevent loosening of the nipple. The coupling 68 receives the lower end of a concentric reducer 70. A pair of washers 72 between the upper end of coupling 68 and the reducer 70 hold a rain shield 74 in place over the housing. Rain shield 74 is open at its lower end to allow flow of ambient air through openings 54 into the housing 46.

Connected to the upper end of the concentric reducer 70 is a coupling 76 in which a spark plug 78 is mounted. A nipple 80 connects coupling 76 to the lower of flanges 34. Nipple 80, coupling 76, reducer 78 and coupling 68 constitute a part of the conduit 22 which extends from the discharge end of pipe 38 to the discharge end of the flare stack 14.

In the preferred form of the invention illustrated in the drawings, a chimney 82 is swaged in nipple 80 and extends upwardly into the separation chamber 28. The annular space between the chimney 80 and conduit 22 is closed by the swaging of the lower end of the chimney. Drain holes 84 are provided in nipple 80 for removal of condensate, as hereinafter described, and additional aspiration of air into conduit 22.

Spark plug 78 is connected with a suitable energizing circuit such as a coil and timing mechanism 86 by a line 88. Timer and coil mechanism 86 causes the intermittent firing of the spark plug at intervals of, for example, 5 seconds. Current for the timer and coil 86 is supplied by a battery 88. A grounding lug 90 is attached to coupling 76 for grounding of the igniter. An insulating gasket in flange connection 34 and the plastic fuel gas supply line prevent grounding of that portion of the igniter below the flange connection through the flare stack or fuel gas line.

In the operation of the igniter of this invention, a fuel such as natural gas or LPG flows through tubing 36 and is discharged from orifice 39 into pipe 38. The flow of fuel gas aspirates air through ports 42 which reduces the pressure within the housing 46 and causes the flexible membranes or gaskets 56 and 58 to be deflected from the inner downstream ends of openings 52 and 54, respectively, to allow flow of air into the housing. The mixture of fuel gas and air travels upwardly through nozzle 47 and nipple 64 into the lower end of the coupling 68 and then upwardly past the spark plug 78 in coupling 76. Additional air is aspirated through ports 44. Firing of the spark plug causes ignition of the combustible mixture with the formation of a flame which travels through conduit 22 and tee 44 to the discharge end of the flare stack. Between firings of the sparkplug, the continued flow of flue gas from line 36 through orifice 39 introduces sufficient combustible gas into the conduit 22 for the flame initiated by the sparkplug to travel to tee 24.

At each firing of the sparkplug and the resultant ignition of the combustible mixture in the conduit 22, there is a surge of back pressure transmitted through the ports 42 and 44 into the housing 46. The high pressure thereby created in the housing 46 relative to the ambient pressure moves the flexible gaskets 56 and 58 over the downstream ends of passages 52 and 54 and prevents flashing around the housing. The closing of the ports 52 and 54 also reduces the noise caused by the surge of backpressure. The hot conduit 22 and the flow of fuel gas into pipe 38 cause a draft that quickly moves the gaskets 56 and 58 from the flanges to re-establish the air flow through passages 52 and 54.

In the embodiment of the invention illustrated in the drawings, control of flow through openings 52 and 54 is by flexible membranes such as gaskets of rubber. Control could be obtained by other means responsive to the pressure differential between the ambient air and the interior of housing 46. For example, the gaskets 56 and 58 could be replaced with metallic discs slidable for a limited distance on the pipe 38 between a position closing the openings 52 and 54 and a position allowing flow of air through those openings.

Because of the periodic firing of the sparkplug 78, which, for example, may be at intervals of approximately five seconds, with the resultant ignition of fuel gas in conduit 22, no problem is caused by wind at the discharge end of the flare stack extinguishing the flare at the discharge end of stack 10. The flare is automatically and quickly reignited.

The arrangement of chimney 82 with the lower end of the annular space between the chimney and the conduit 22, including nipple 80, provides a trap to prevent flow to the sparkplug 78 of any condensate that may form. Condensate that condenses on the walls of conduit 22 drains through the annular space surrounding chimney 82 to drain holes 84 through which the condensate drains from the system.

This invention provides apparatus for maintaining a flame at the discharge end of a flare stack even though the rate of flow and the composition of the waste gases should vary widely or the atmospheric conditions should be such as to extinguish the flare. Flashback from the intermittent ignition of the fuel gas supplied to the pilot flare is eliminated and noise is greatly reduced. The intermittent ignition eliminates the necessity of supplying sufficient fuel gas to keep a pilot flare burning continuously, thereby permitting an important saving in the fuel required to maintain a flare of the waste gas. The substantially instantaneous flame is adequate to ignite the waste gas. During use of the igniter, insects or other debris may be drawn into the housing and interfere with operation of the igniter. The transparent housing allows observation of the operation of the igniter to determine whether cleaning is required.

I claim:

1. Apparatus for igniting a flare stack comprising a pipe having an upstream end and a downstream end, a fuel gas supply tubing opening into the pipe at the upstream end, orifice means in the pipe adapted to discharge a stream of fuel gas longitudinally in the pipe to form an aspirator, ports in the wall of the pipe, a housing surrounding the pipe, openings through the housing, a conduit connected to the downstream end of the pipe to receive the effluent therefrom and extending to and having an outlet at the discharge end of the flare stack, a sparkplug in the conduit, means for periodically energizing the sparkplug to ignite fuel in the conduit, and closure means within the housing covering the openings, said closure means being movable from a position over and closing the openings when pressure within the housing is higher than ambient pressure to a position uncovering and opening the openings when the pressure in the housing is lower than the ambient pressure.

2. Apparatus as set forth in claim 1 characterized by the flare stack being vertical and the conduit having an outlet at the upper end of the flare stack.

3. Apparatus as set forth in claim 1 characterized by the flare stack being horizontal.

4. Apparatus as set forth in claim 1 in which the housing includes a sleeve concentric with and spaced from the pipe, a flange at each end of the sleeve closing the end of the annular space between the pipe and the sleeve, said openings being in at least one of the flanges.

5. Apparatus as set forth in claim 2 characterized by a rain shield over the spark plug.

6. Apparatus as set forth in claim 4 characterized by the closure means comprising a flexible gasket secured to the inner surface of the flange and having a portion overlying the openings movable in response to changes of pressure within the housing.

7. Apparatus as set forth in claim 1 characterized by the ports in the pipe being downstream of the orifice means.

8. Apparatus as set forth in claim 1 characterized by first ports in the pipe being located downstream of the orifice means, a nozzle having an outer diameter smaller than the inner diameter of the pipe mounted in the pipe downstream of the first ports to receive all of the fuel gas and the air aspirated through the first ports, and second ports in the pipe surrounding the nozzle.

9. Apparatus as set forth in claim 1 characterized by the conduit extending across the discharge end of the flare stack with the outlet from the conduit in the stream of effluent from the stack.

10. Apparatus as set forth in claim 9 characterized by a tee at the discharge end of the conduit.

11. Apparatus as set forth in claim 2 characterized by a moisture trap in the conduit above the spark plug.

12. Apparatus as set forth in claim 11 characterized by the moisture trap comprising a chimney extending upwardly in the conduit above the spark plug, said chimney having an outer diameter less than the inner diameter of the conduit, closing means in the space between the chimney and the conduit at the lower end of the chimney, and drain holes in the conduit immediately above said closing means.

13. Apparatus as set forth in claim 12 characterized by an enlarged chamber in the conduit at the level of the upper end of the chimney.

14. In apparatus for lighting a flare at the outlet of a stack, aspirating air through openings in a housing into a pipe, admixing the aspirated air with a fuel gas, periodically igniting the resultant mixture to form a flame and discharging the flame adjacent the outlet of the stack, the improvement comprising closure means adjacent the openings adapted to close the openings when the pressure of the mixture exceeds the ambient pressure and open the openings when the pressure of the mixture is lower than the ambient pressure.

15. Apparatus as set forth in claim 14 in which the closure means comprise a flexible membrane mounted in the housing overlying the downstream end of the openings, said flexible membrane being displaceable from the downstream end of the openings in response to pressure differential between the housing and ambient air.

* * * * *